US011208774B2

(12) United States Patent
Crawley et al.

(10) Patent No.: US 11,208,774 B2
(45) Date of Patent: Dec. 28, 2021

(54) RETAINING MEMBERS

(71) Applicant: Tensator Group Ltd, Milton Keynes (GB)

(72) Inventors: Peter James Crawley, Milton Keynes (GB); Benjamin James Sully, Milton Keynes (GB)

(73) Assignee: TENSATOR GROUP LTD

( * ) Notice: Subject to any disclaimer, the term of this patent is extended or adjusted under 35 U.S.C. 154(b) by 319 days.

(21) Appl. No.: 16/267,429

(22) Filed: Feb. 5, 2019

(65) Prior Publication Data

US 2019/0249381 A1 Aug. 15, 2019

(30) Foreign Application Priority Data

Feb. 14, 2018 (GB) ..... 1802375

(51) Int. Cl.
*E01F 13/02* (2006.01)
*E01F 9/654* (2016.01)
*E01F 9/688* (2016.01)

(52) U.S. Cl.
CPC ..... *E01F 13/028* (2013.01); *E01F 9/654* (2016.02); *E01F 9/688* (2016.02)

(58) Field of Classification Search
CPC ..... E04H 17/006; E04H 17/10; E04H 17/12; E04H 17/124; E01F 9/654; E01F 9/688; E01F 13/022; E01F 13/028
USPC ..... 116/63 P, 63 C; 256/46, 47
See application file for complete search history.

(56) References Cited

U.S. PATENT DOCUMENTS 4,223,872 A * 9/1980 Boal ..... E04H 17/12 256/48
5,269,251 A * 12/1993 Freeman ..... E01F 13/02 116/63 C
6,149,135 A * 11/2000 Hlavin ..... A63B 61/003 256/12.5
6,583,363 B1 * 6/2003 Wilson, Jr. ..... H01B 17/145 174/158 F
6,872,892 B1 * 3/2005 Burdick ..... H01B 17/145 174/158 F
7,988,133 B2 * 8/2011 Gripne ..... E01F 15/025 256/13.1
D682,054 S * 5/2013 Gary ..... A63B 61/003 D8/1
8,894,041 B2 * 11/2014 Sachs ..... E04H 17/12 256/57
10,358,840 B2 * 7/2019 Hiner ..... E04H 17/12
2003/0222254 A1 * 12/2003 Bergendahl ..... E01F 15/06 256/13.1

(Continued)

FOREIGN PATENT DOCUMENTS

DE 2039580 A1 * 2/1971 ..... E04H 17/12
FR 2 997 971 A1 5/2014

(Continued)

*Primary Examiner* — Amber R Anderson
*Assistant Examiner* — Zachary A Hall
(74) *Attorney, Agent, or Firm* — Ostrolenk Faber LLP

(57) ABSTRACT

A retaining member is described. The retaining member forms part of a stanchion of a barrier assembly. The retaining member includes an undulating open channel extending completely through the retaining member. The channel is adapted, in use, to retain a flexible elongate member (e.g., a rope or cord) and to restrain movement of the flexible elongate member relative to the retaining member.

14 Claims, 8 Drawing Sheets

(56) References Cited

U.S. PATENT DOCUMENTS

| | | | | |
|---|---|---|---|---|
| 2005/0076586 | A1* | 4/2005 | Venegas, Jr. | E01F 9/623 52/169.9 |
| 2008/0011995 | A1* | 1/2008 | Ross | E04H 17/10 256/42 |
| 2008/0105860 | A1* | 5/2008 | Gallea | E04H 17/20 256/32 |
| 2013/0333610 | A1* | 12/2013 | Eccless | E01F 13/028 116/63 C |
| 2018/0142834 | A1* | 5/2018 | Cuttill | G09F 7/00 |

FOREIGN PATENT DOCUMENTS

| | | | | |
|---|---|---|---|---|
| KR | 101895899 | B1 * | 9/2018 | E04H 17/20 |
| WO | WO-2017031546 | A1 * | 3/2017 | E04H 17/20 |

* cited by examiner

RETAINING MEMBERS

CROSS-REFERENCE TO RELATED APPLICATION

The present application claims priority to United Kingdom Patent Application No. 1802375.4, filed Feb. 14, 2018, the content of which is incorporated herein by reference.

TECHNICAL FIELD

The present invention relates to retaining members, and in particular to retaining members that form part of a stanchion of a barrier assembly and can be used to retain and suspend a flexible elongate member (e.g., a rope or cord) to form a temporary or permanent barrier.

SUMMARY OF INVENTION

The present invention provides a retaining member mountable by a lower part to a post to define a stanchion of a barrier assembly, the retaining member including an undulating open channel extending completely through the retaining member between first and second openings in a side surface of the retaining member;

wherein the undulating open channel is:

defined by opposing undulating side walls and a base wall formed between the side walls and is adapted, in use, to retain a flexible elongate member and to restrain movement of the flexible elongate member relative to the retaining member.

As used herein the term "undulating" is intended to mean that the channel is not linear but includes one or more successive curves or bends in alternate directions along its length, or even more abrupt changes of direction. For example, the channel can have a wavy, zigzag or tortuous form through the retaining member.

The channel can be open at an upper part of the retaining member. In particular, the channel can be defined by an opening in an upper surface of that upper part, preferably an undulating opening. The upper surface can be substantially planar or have a domed shape, for example. The flexible elongate member can be inserted into the channel from above without having to thread it through an opening or aperture.

The retaining member can further comprise one or more retainers at the upper part of the retaining member that extend only partly over the channel. In use, the retainers will extend over the flexible elongate member that is received in the channel to prevent it from being pulled upwards and out of the channel accidentally. The retainers will not prevent the deliberate or required insertion of the flexible elongate member into the channel, nor its removal therefrom.

The retaining member can further comprise a substantially cylindrical side surface. The channel can extend through the retaining member between first and second openings in the cylindrical side surface. At least part of the side surface can include a circumferential groove for receiving a loop of the flexible elongate member. The retaining member is not necessarily limited to a general cylindrical construction. In other arrangements, the retaining member can include a plurality of side surfaces and the channel can extend through the retaining member between first and second openings in respective side surfaces. At least part of one side surface can include a groove for receiving a loop of the flexible elongate member.

The channel can be specifically adapted or arranged to restrain lateral movement of the flexible elongate member through the channel. Such lateral movement can be restrained because the wavy, zigzag or tortuous shape of the channel forces the flexible elongate member to adopt a similar undulating course through the channel. The channel is defined by opposing side walls and a base wall formed between the side walls. The base wall acts to prevent a flexible elongate member moving out of a lower side of the channel. The side walls may be arcuate or any other suitable shape. The side walls may be continuous or may have gaps formed therein so long as, in use, they act to retain a flexible elongate member of the channel. For example, the side walls may have substantially vertical gaps formed therein.

In use, the flexible elongate member can be in contact with the side walls, for example at locations along the channel where the channel changes direction. Such contact (e.g., friction contact) with the side walls restrains against lateral movement of the elongate flexible member through the channel. The side walls can also define one or more contact points for "biting" contact with the flexible elongate member to provide additional restraint. The contact points can be defined by chamfered edges of the side walls, for example, or by any other suitable contact feature.

The retaining member can be formed of any suitable material, e.g., a plastics material or die cast metal. In one arrangement, the retaining member is injection moulded as a single piece.

The present invention further provides a stanchion of a barrier assembly, the stanchion including a post and at an upper part of the post a retaining member, the retaining member including an undulating open channel extending completely through the retaining member that is adapted, in use, to retain a flexible elongate member and to restrain movement of the flexible elongate member relative to the retaining member.

The retaining member of the stanchion can be as described above.

The retaining member can be integrally formed with the post or mountable to it. In the latter case, the retaining member can include a lower part that is sized and shaped to allow it to be mounted to the post. The retaining member can be releasably or fixably mounted as required.

The present further provides a barrier assembly including at least two stanchions at spaced locations and a flexible elongate member, each stanchion including a post and at an upper part of the post a retaining member, the retaining member including an undulating open channel extending completely through the retaining member that is adapted to retain the flexible elongate member and to restrain movement of the flexible elongate member relative to the retaining member, and where the flexible elongate member extends between the stanchions to define a barrier.

The flexible elongate member (e.g., a rope or cord) can be made of any suitable material and is preferably suspended between the stanchions.

DRAWINGS

Figure 9:
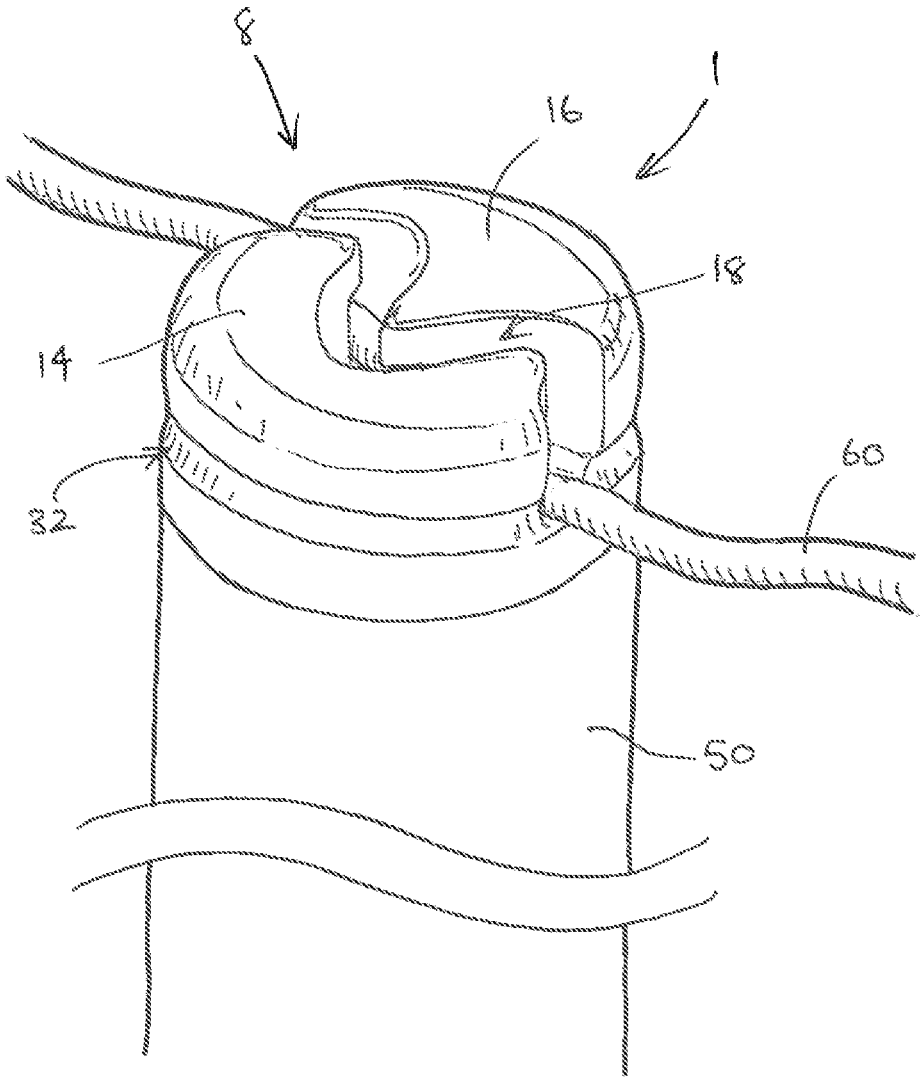
FIG. 9 is a perspective view of the retaining member of FIG. 1 mounted to a post and showing a rope passing through the channel.
Figure 12:
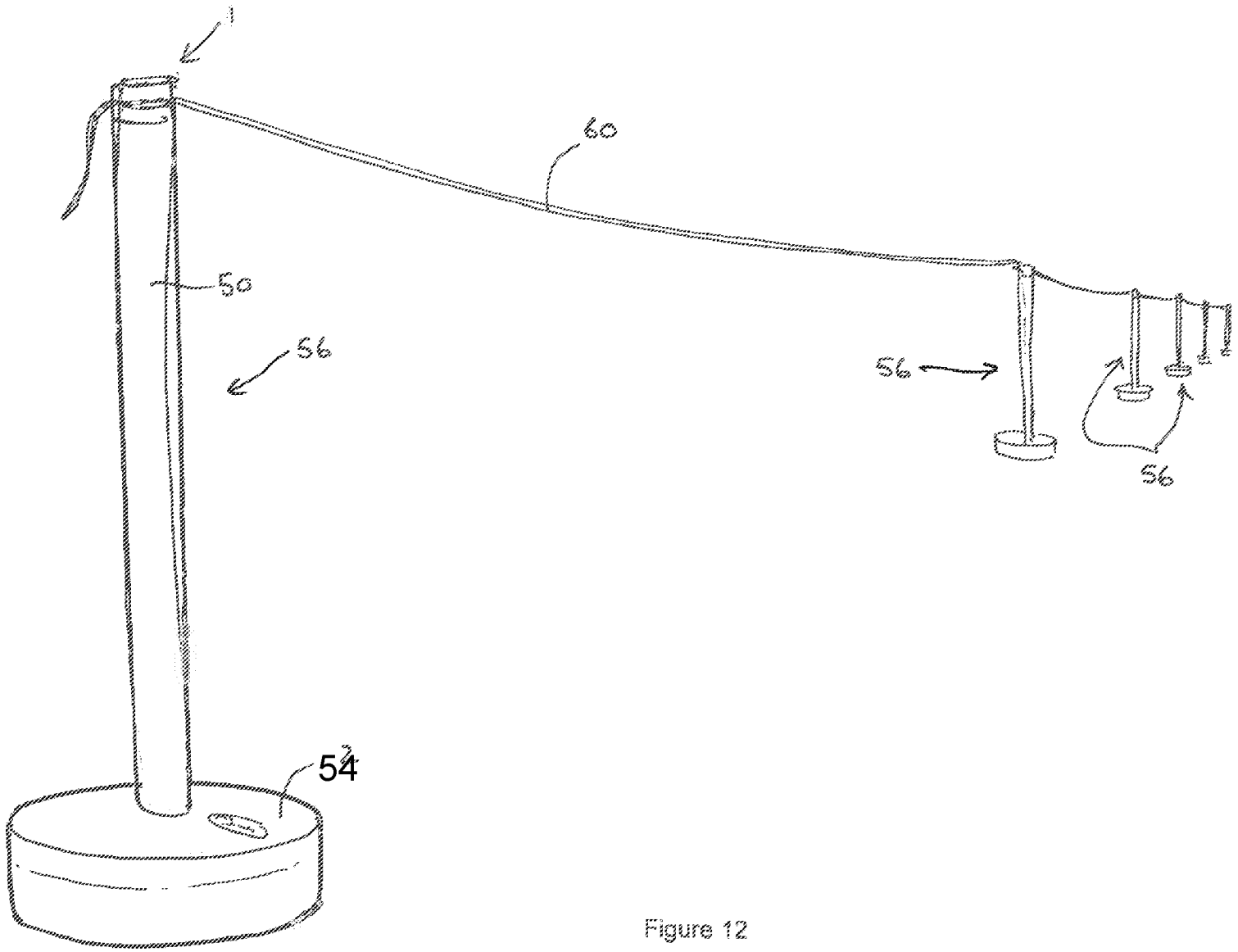
FIG. 12 shows a barrier assembly according to the present invention.

FIGS. 1 to 6 show a retaining member 1 according to the present invention. The retaining member 1 can be injection moulded as a single piece from a suitable plastics material, for example. A lower part 2 of the retaining member is sized and shaped (e.g., with a cylindrical side wall 4 and radially extending spines 6) to be mountable inside a post 50 as shown in FIG. 9. The post 50 can be made of a plastics material or metal, for example, and the retaining member 1 can be fixed to it by a suitable adhesive, welding, or mechanical fixing such as a screw or rivet, for example. As shown in FIG. 12, the post 50 can also be mounted to a suitable base 54 to define a stanchion 56.

The retaining member 1 includes an upper part 8 that extends above the post 50. The upper part 8 includes a planar upper surface 10 and a cylindrical side surface 12. The upper part 8 is divided into two opposing parts 14, 16 by an open undulating (or wavy) channel 18. The opening 20 at the planar upper surface 10 is undulating (or wavy) and has chambered edges 22.

The channel 18 extends completely through the upper part 8 of the retaining member 1 between opposing first and second openings 24, 26 in the cylindrical side surface 12.

The planar upper surface 10 of the first part 14 is generally u-shaped and has two retainers 28 that extend partly over the channel 18. The planar upper surface 10 of the second part 16 is generally m-shaped and has a single retainer 30 at an apex that extends partly over the channel 18. The retainers 28, 30 are provided at spaced retaining locations along the channel 18 with the retainers 28 being located at opposite ends of the channel (i.e., close to the openings 24, 26 in the cylindrical side surface 12) and the retainer 30 being located at the centre of the channel. The retainers 28, 30 have a rounded shape and are designed so as the slightly narrow the opening 20 in the planar upper surface 10 at each retaining location. In use, the rope 60 can be deliberately pushed past the retainers 28, 30 into the channel 18 with some degree of effort. The retainers 28, 30 then retain the rope 60 within the channel 18 so that it cannot be easily or accidentally pulled out of the channel.

The cylindrical side surface 12 includes a circumferential groove 32. The groove 32 includes a series of openings 34 defined between circumferentially-spaced vertical webs.

Figure 1:
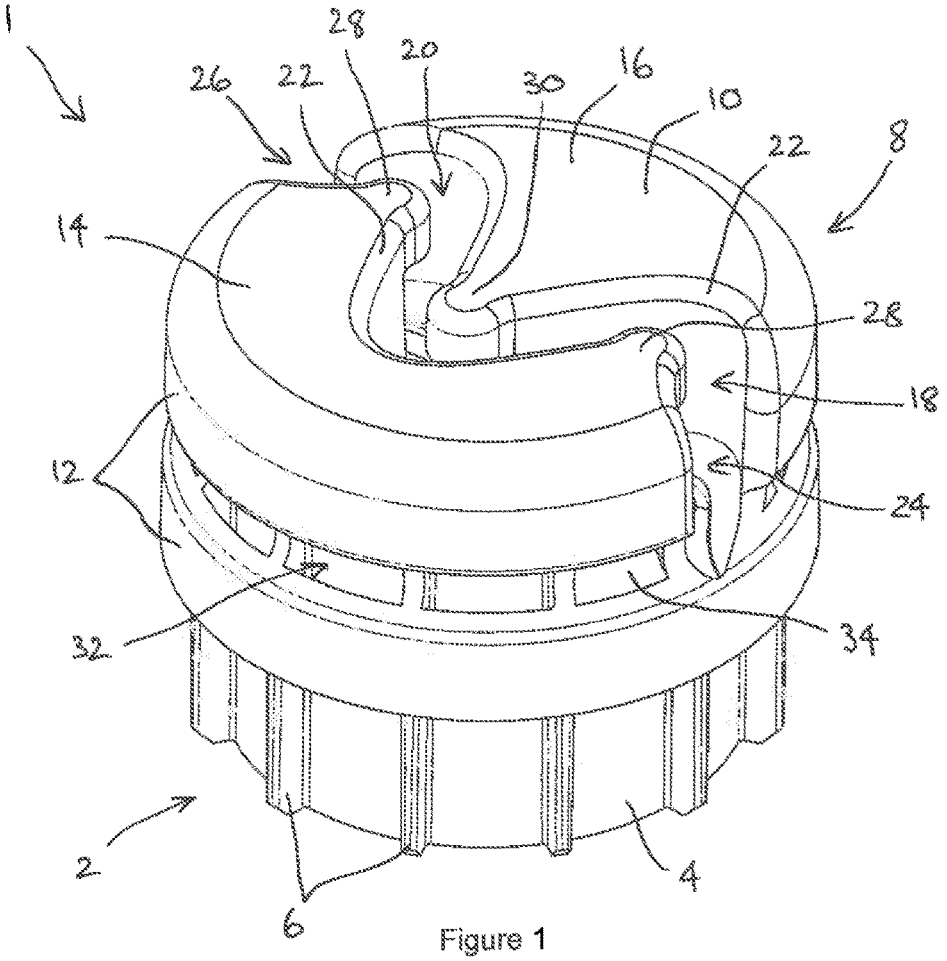
FIG. 1 is a perspective view of a retaining member according to the present invention.
Figure 2:
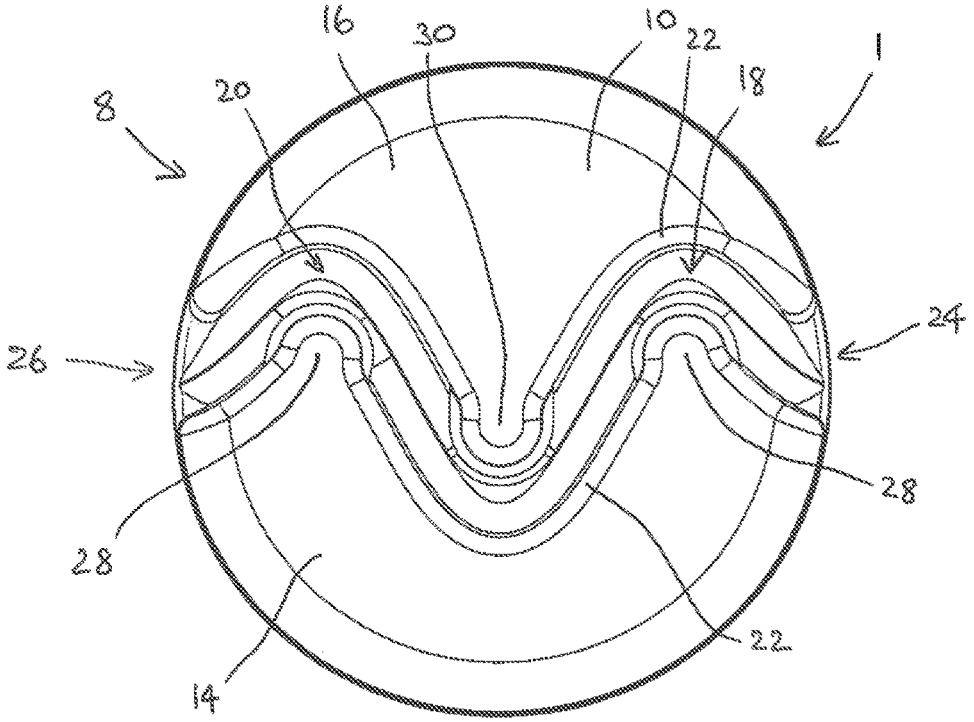
FIG. 2 is a top view of the retaining member of FIG. 1.
Figure 3:
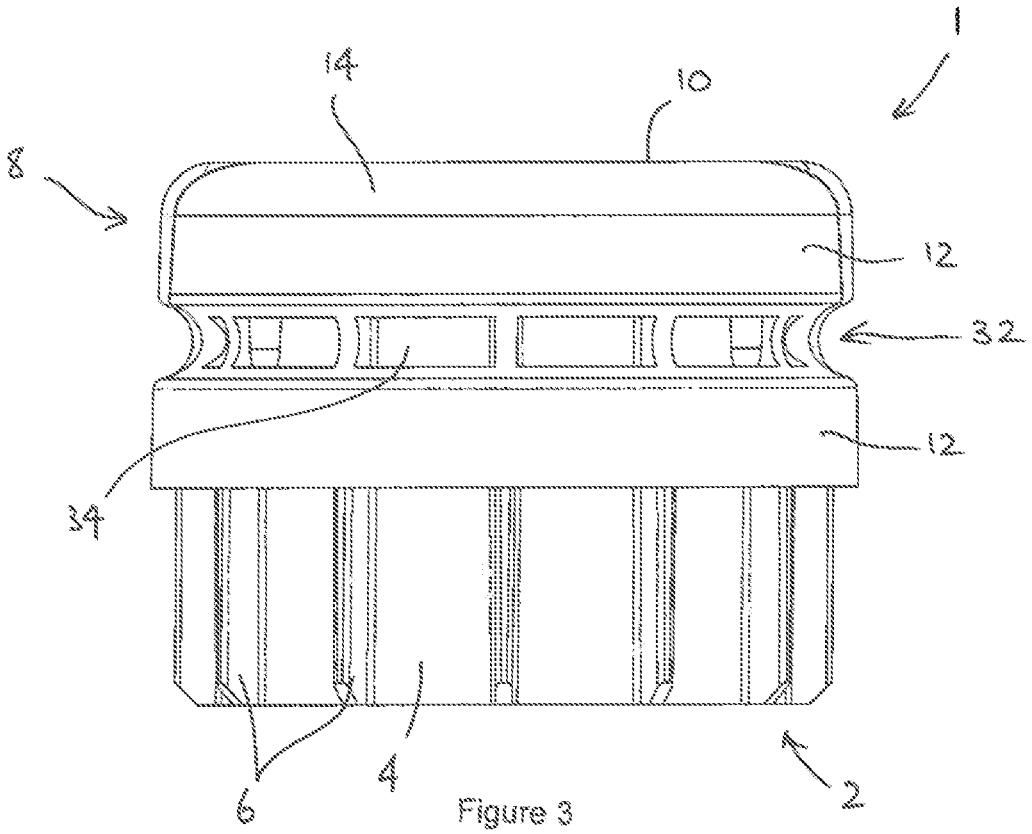
FIG. 3 is a front view of the retaining member of FIG. 1.
Figure 5:
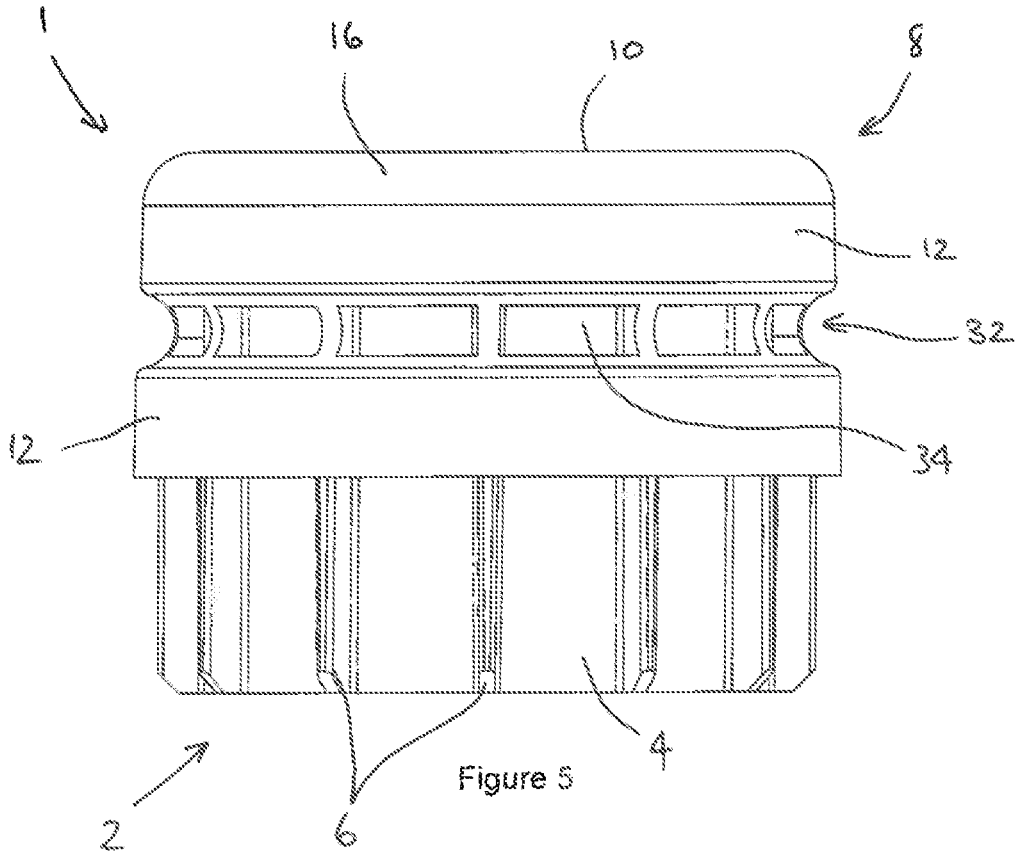
FIG. 5 is a rear view of the retaining member of FIG. 1.
Figure 4:
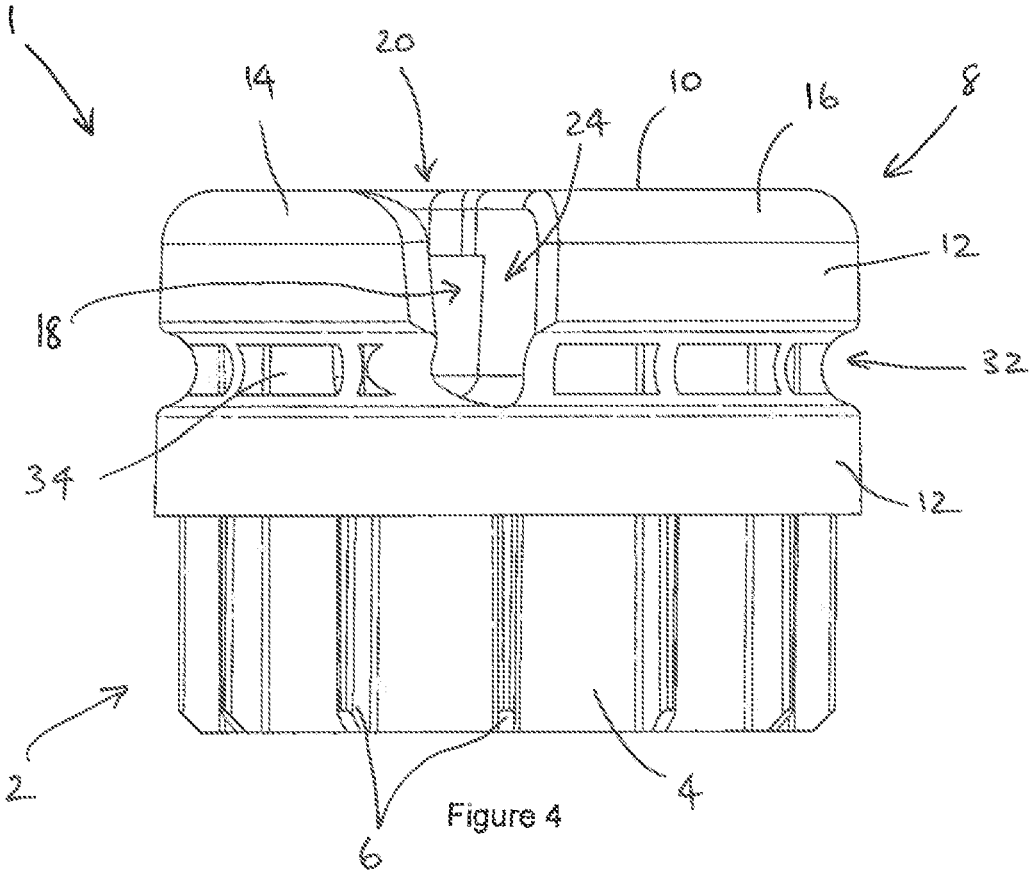
FIG. 4 is a right side view of the retaining member of FIG. 1.
Figure 6:
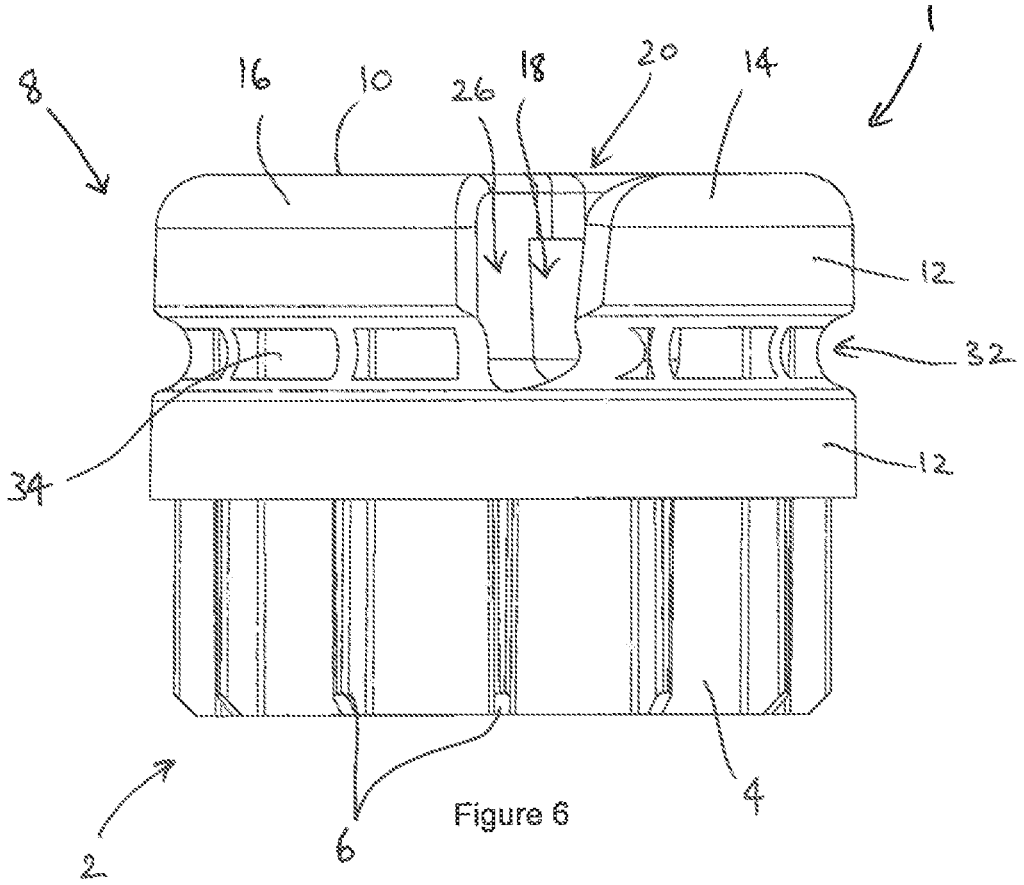
FIG. 6 is a left side view of the retaining member of FIG. 1.
Figure 7:
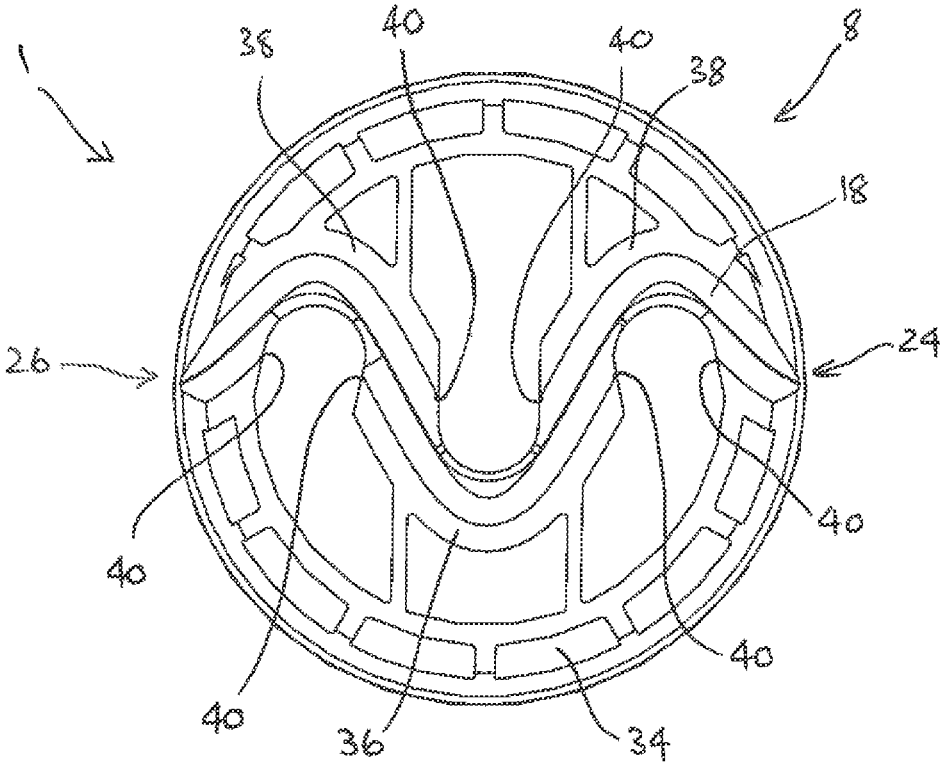
FIG. 7 is a cross section view through the upper part of the retaining member of FIG. 1.

With particular reference to FIG. 7, which shows a cross section through the upper part 8 of the retaining member 1, the channel 18 is defined by opposing arcuate side walls 36, 38. A base wall is formed between the side walls and defines a bottom of the channel 18. The side walls do not need to be continuous and can include one or more gaps. For example, the side wall 38 has a gap at the centre of the channel 18. The gaps can be located where the channel changes direction and the gap edges of the side wall can define contact points—see below. The undulating (or wavy) shape of the channel 18 means that when the rope 60 is received in the channel, it is forced to adopted a similar undulating course between the openings 24, 26 in the cylindrical side surface 12 and is brought into friction contact with the side walls 36, 38, particularly at locations along the channel where the channel changes direction. This contact between the rope 60 and the side walls 36, 38 restrains the lateral movement of the rope through the channel 18. In other words, the rope 60 can normally only be moved laterally through the channel 18 with some degree of effort so that once the rope is received in the channel, it will not slip. Moreover, the rope 60 is forced into contact with contact points 40 that are defined by chambered edges of the side walls 36, 38 and are provided at spaced locations along the channel 18. The chamfered edges can "bite" into the rope 60 to provide additional restraint against lateral movement through the channel 18. This "biting" contact between the rope 60 and the contact points 40 is shown in FIG. 8.

Figure 8:
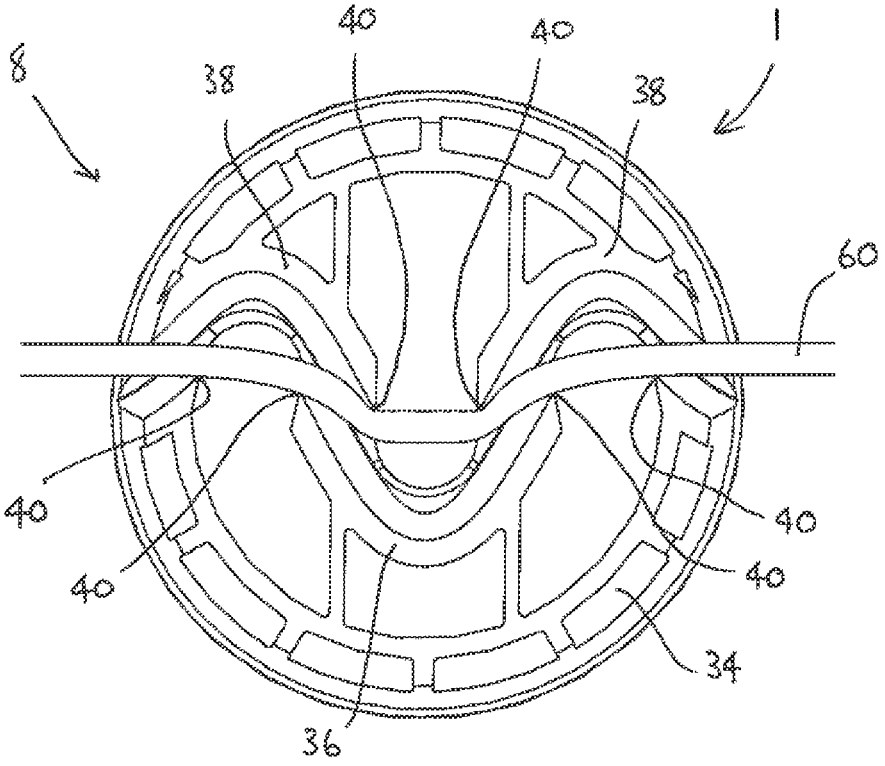
FIG. 8 is a cross section view through the upper part of the retaining member of FIG. 1 that shows a rope passing through the channel.
Figure 10:
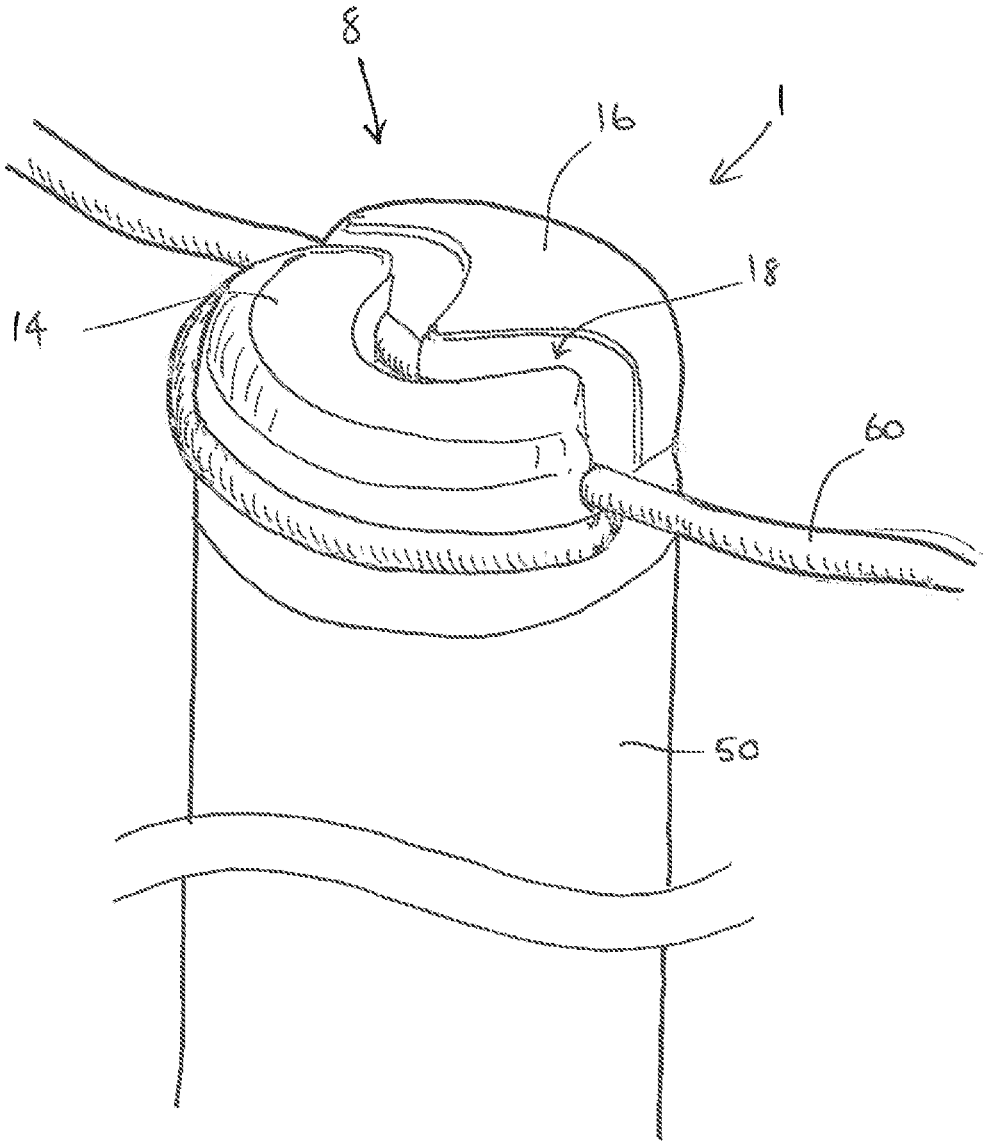
FIG. 10 is a perspective view of the retaining member of FIG. 1 mounted to a post and showing a rope passing through the channel and looped around the retaining member.

In use, the rope 60 can simply be received in the channel 18 as shown in FIG. 8 where it is restrained against lateral movement by the undulating course it is forced to take through the channel 18 and by the "biting" contact with the chambered edges of the side walls 36, 38 at the contact points 40. But it is possible for the rope 60, after being received in the channel 18, to also be looped partly around the upper part of the retaining member 1, where the looped rope would be received in the circumferential groove 32, and then received through the channel for a second time. In other words, the channel 18 can receive two separate portions of the rope 60 and is normally sized accordingly. Once the rope 60 is pulled tight as shown in FIG. 10, the groove 32 will prevent upward or downward movement relative to the retaining member 1. The rope 60 can be looped around either of the parts 14, 16.

Figure 11C:
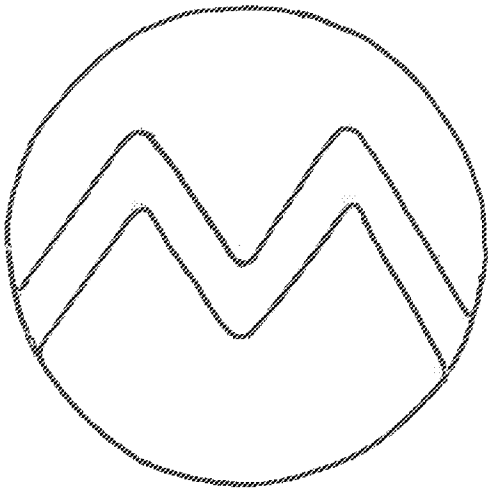
FIGS. 11A to 11C show alternative channels.
Figure 11B:
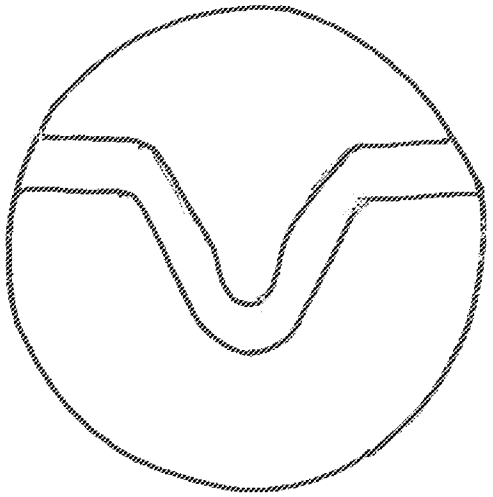
Figure 11A:
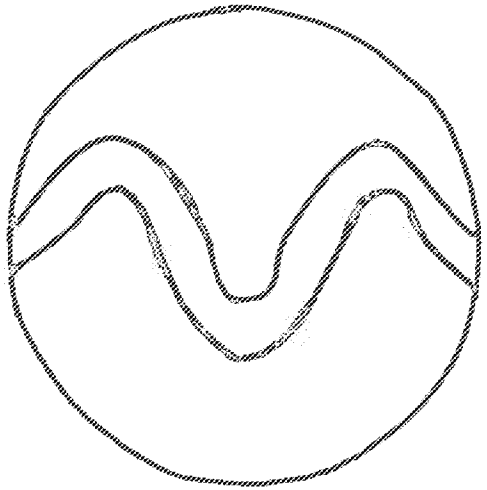

FIGS. 11A to 11C show alternative options for the shape of the channel of the retaining member 1. It will be readily appreciated that other options are also possible.

FIG. 12 shows a barrier assembly where a plurality of stanchions 56 are positioned at spaced locations (e.g., a few metres apart) and a rope 60 is received in the channel of each retaining member 1 to form a suspended barrier that extends between each stanchion. Any suitable rope can be used.

Such a barrier assembly is easy and quick to assemble and can be used for many different purposes, e.g., for general crowd control or to restrict pedestrian or vehicular access to a particular area.

The invention claimed is:

1. A retaining member mountable by a lower part to a post to define a stanchion of a barrier assembly, the retaining member including an undulating open channel that defines a serpentine path extending completely through the retaining member between first and second openings in a side surface of the retaining member; one or more retainers at an upper part of the retaining member that extend only partly over the undulating open channel;

wherein the undulating open channel is:

defined by opposing undulating side walls and a base wall formed between the side walls and is adapted, in use, to retain a flexible elongate member and to restrain movement of the flexible elongate member relative to the retaining member, and the undulating open channel is open at the upper part of the retaining member.

2. The retaining member according to claim 1, wherein the side surface is substantially cylindrical, and wherein the channel extends between the first and second openings in the cylindrical side surface.

3. The retaining member according to claim 2, wherein at least part of the side surface includes a circumferential groove.

4. The retaining member according to claim 1, wherein the channel is adapted to restrain lateral movement of the flexible elongate member through the channel.

5. The retaining member according to claim 4, wherein the undulating side walls of the channel define contact points for "biting" contact with the flexible elongate member.

6. A stanchion of a barrier assembly, the stanchion including a post and at an upper part of the post a retaining member, the retaining member including an undulating open channel that defines a serpentine path extending completely through the retaining member that is adapted, in use, to retain a flexible elongate member and to restrain movement of the flexible elongate member relative to the retaining member, the undulating open channel extending between first and second openings in a side surface of the retaining member; the retaining member further including one or more retainers at an upper part of the retaining member that extend only partly over the undulating open channel;

wherein the undulating open channel is:

defined by opposing undulating side walls and a base wall formed between the side walls, and the undulating open channel is open at the upper part of the retaining member.

7. The stanchion according to claim 6, wherein the side surface is substantially cylindrical, and wherein the channel extends between the first and second openings in the cylindrical side surface.

8. The stanchion according to claim 7, wherein at least part of the side surface includes a circumferential groove.

9. The stanchion according to claim 6, wherein the channel is adapted to restrain lateral movement of the flexible elongate member through the channel.

10. The stanchion according to claim 9, wherein the channel is defined by the opposing arcuate side walls that define contact points for "biting" contact with the flexible elongate member.

11. A barrier assembly including at least two stanchions at spaced locations and a flexible elongate member, each stanchion of the at least two stanchions including a post and at an upper part of the post a retaining member, the retaining member including an undulating open channel that defines a serpentine path extending completely through the retaining member that is adapted, in use, to retain the flexible elongate member and to restrain movement of the flexible elongate member relative to the retaining member, the undulating open channel extending between first and second openings in a side surface of the retaining member, and the retaining member further including one or more retainers at an upper part of the retaining member that extend only partly over the undulating open channel;

wherein the undulating open channel is:

defined by opposing undulating side walls and a base wall formed between the side walls, the undulating open channel is open at the upper part of the retaining member, and the flexible elongate member extends between the at least two stanchions.

12. The retaining member according to claim 1, wherein the undulating sidewalls include first and second spaced side walls, the base wall being between the first and second spaced side walls, and wherein the first side wall includes a concavity, the second side wall includes a convexity received partially in the concavity of the first side wall while spaced from the first side wall.

13. The retaining member according to claim 12, wherein the first side wall includes a convexity adjacent the concavity of the first side wall, and the second side wall includes a concavity that is adjacent the convexity of the second side wall and at least partially receives the convexity of the first side wall.

14. The retaining member according to claim 12, wherein the first side wall includes a first convexity and a second convexity each adjacent the concavity of the first side wall, the second side wall includes a first concavity that is adjacent the convexity of the second side wall and at least partially receives the first convexity of the first side wall, and the second side wall includes a second concavity that is adjacent the convexity of the second side wall and at least partially receives the second convexity of the first side wall.

* * * * *